US010978221B2

(12) United States Patent
Cao

(10) Patent No.: US 10,978,221 B2
(45) **Date of Patent: *Apr. 13, 2021**

(54) REINFORCED ELECTRIC WIRE AND METHODS OF MAKING THE SAME

(71) Applicant: POLYGROUP MACAU LIMITED (BVI), Tortola (VG)

(72) Inventor: Xiaofeng Cao, Shenzhen (CN)

(73) Assignee: POLYGROUP MACAU LIMITED (BVI), Road Town (VG)

( * ) Notice: Subject to any disclaimer, the term of this patent is extended or adjusted under 35 U.S.C. 154(b) by 0 days.

This patent is subject to a terminal disclaimer.

(21) Appl. No.: 17/000,821

(22) Filed: Aug. 24, 2020

(65) Prior Publication Data

US 2020/0388416 A1 Dec. 10, 2020

Related U.S. Application Data

(63) Continuation of application No. 16/669,991, filed on Oct. 31, 2019, now Pat. No. 10,755,835, which is a (Continued)

(51) Int. Cl.
*F21V 21/04* (2006.01)
*H01B 7/18* (2006.01)

(Continued)

(52) U.S. Cl.
CPC ..... *H01B 7/1825* (2013.01); *H01B 3/421* (2013.01); *H01B 3/441* (2013.01); *H01B 3/443* (2013.01);

(Continued)

(58) Field of Classification Search
CPC . H01B 7/02; H01B 7/04; H01B 7/182; H01B 4/1825; H01B 3/421; H01B 3/441;

(Continued)

(56) References Cited

U.S. PATENT DOCUMENTS 452,340 A 5/1891 Conner
453,340 A 5/1891 Conner (Continued)

FOREIGN PATENT DOCUMENTS

CN 203323058 U 12/2013
CN 203549524 U 4/2014

(Continued)

OTHER PUBLICATIONS

Underwriters Laboratories Standard for Safety for Seasonal and Holiday Decorative Products, UL 588, 18th Ed., dated Feb. 15. 2002 ("UL Standards").

*Primary Examiner* — William H. Mayo, III
(74) *Attorney, Agent, or Firm* — Troutman Pepper Hamilton Sanders LLP; Ryan A. Schneider; Christopher C. Close, Jr.

(57) ABSTRACT

The invention relates to reinforced electric wires, particularly reinforced electric wires as used in holiday lighting such as Christmas light strings. In some embodiments, the reinforced electric wire has a conductor, a reinforcing string or one or more reinforcing threads, and an insulator jacket. In some embodiments, the conductor has a single conductor strand. In some embodiments, the conductor has a plurality of conductor strands. In some embodiments, the wire has an insulator jacket having a plurality of channels therein, where a conductor is passed through the center channel, and reinforcing threads are passed through the other channels.

20 Claims, 10 Drawing Sheets

Related U.S. Application Data continuation of application No. 15/273,037, filed on Sep. 22, 2016, now Pat. No. 10,522,270.

(60) Provisional application No. 62/272,812, filed on Dec. 30, 2015.

(51) Int. Cl.

| | |
|---|---|
| ***H01B 17/18*** | (2006.01) |
| ***H01B 3/42*** | (2006.01) |
| ***H01B 3/44*** | (2006.01) |
| ***H01B 13/06*** | (2006.01) |
| *F21S 4/10* | (2016.01) |
| *F21W 121/04* | (2006.01) |
| *H01B 13/02* | (2006.01) |

(52) U.S. Cl.

CPC ..... *H01B 7/182* (2013.01); *H01B 13/06* (2013.01); *H01B 17/18* (2013.01); *F21S 4/10* (2016.01); *F21W 2121/04* (2013.01); *H01B 13/02* (2013.01)

(58) Field of Classification Search

CPC ..... H01B 3/443; H01B 13/06; H01B 17/18; H01B 13/02; F21S 4/10; A47G 33/10

USPC ..... 174/102 R, 103, 105, 106 R, 108, 109, 174/110 R, 113 R

See application file for complete search history.

(56) References Cited

U.S. PATENT DOCUMENTS

| | | | | |
|---|---|---|---|---|
| 1,610,954 | A | 12/1926 | Fawcett | |
| 1,656,148 | A | 1/1928 | Harris | |
| 2,050,298 | A | 8/1936 | Everett | |
| 2,193,429 | A | 3/1940 | McConnell | |
| 2,206,703 | A | 7/1940 | Lowe | |
| 2,234,560 | A | 3/1941 | Keyes | |
| 2,427,507 | A | 9/1947 | Powell et al. | |
| 2,953,627 | A | 9/1960 | Malneritch et al. | |
| 3,214,579 | A | 10/1965 | Pacini | |
| 3,291,891 | A | 12/1966 | Sharp | |
| 3,324,233 | A | 6/1967 | Bryant | |
| 3,737,490 | A | 6/1973 | Nicholson | |
| 3,831,132 | A | 8/1974 | Bowden, Jr. et al. | |
| 3,862,353 | A | 1/1975 | Morton et al. | |
| 4,097,686 | A | 6/1978 | Gladenbeck et al. | |
| 4,259,544 | A | 3/1981 | Litauer | |
| 4,322,574 | A | 3/1982 | Bow et al. | |
| 4,449,012 | A | 5/1984 | Voser | |
| 4,761,520 | A | 8/1988 | Wade et al. | |
| 5,156,715 | A | 10/1992 | Starnes | |
| 5,159,157 | A | 10/1992 | Diegmann | |
| 5,216,205 | A | 6/1993 | Fujii et al. | |
| 5,280,137 | A | 1/1994 | Ward | |
| 5,356,710 | A | 10/1994 | Rinehart | |
| 5,689,090 | A | 11/1997 | Bleich et al. | |
| 5,804,222 | A | 9/1998 | Brown et al. | |
| 5,912,436 | A | 6/1999 | Sanchez et al. | |
| 6,303,868 | B1 | 10/2001 | Kawai | |
| 6,982,385 | B2 | 1/2006 | Wu | |
| 7,060,209 | B2 | 6/2006 | Balconi et al. | |
| 7,793,409 | B2 | 9/2010 | Varkey | |
| 7,806,559 | B2 * | 10/2010 | Reed | F21S 4/10 362/249.02 |
| 7,847,192 | B2 | 12/2010 | Grögl et al. | |
| 8,692,120 | B2 | 4/2014 | Debladis et al. | |
| 9,140,438 | B2 | 9/2015 | Chen | |
| 9,157,588 | B2 * | 10/2015 | Chen | F21S 4/10 |
| 9,243,788 | B2 | 1/2016 | Chen | |
| 2001/0023776 | A1 | 9/2001 | Zingheim | |
| 2004/0222012 | A1 | 11/2004 | Wlos | |
| 2007/0159822 | A1 | 7/2007 | Lin | |
| 2010/0089614 | A1 | 4/2010 | Debladis et al. | |
| 2011/0005805 | A1 | 1/2011 | Eshima | |
| 2011/0100677 | A1 * | 5/2011 | Chen | H01B 5/105 174/126.2 |
| 2011/0147079 | A1 | 6/2011 | Dlugas | |
| 2013/0062095 | A1 | 3/2013 | Huang et al. | |
| 2013/0108808 | A1 * | 5/2013 | Leung | H01R 33/06 428/18 |
| 2013/0296520 | A1 | 11/2013 | Flenniken | |
| 2013/0299211 | A1 | 11/2013 | Pope | |
| 2013/0301246 | A1 * | 11/2013 | Chen | A41G 1/007 362/123 |
| 2015/0077999 | A1 * | 3/2015 | Chen | F21V 23/001 362/249.08 |
| 2015/0167944 | A1 | 6/2015 | Chen | |
| 2015/0338036 | A1 | 11/2015 | Han | |
| 2015/0359066 | A1 * | 12/2015 | Loomis | H05B 45/00 362/123 |
| 2016/0040864 | A1 | 2/2016 | Chen | |
| 2017/0257324 | A1 * | 9/2017 | Balmakhtar | H04L 47/805 |
| 2019/0110624 | A1 * | 4/2019 | Puleo | A47G 33/06 |
| 2019/0110625 | A1 * | 4/2019 | Hale | F21V 23/06 |
| 2019/0316743 | A1 * | 10/2019 | Planinsek | F21V 21/088 |

FOREIGN PATENT DOCUMENTS

| | | | | |
|---|---|---|---|---|
| CN | 203868790 U | | 10/2014 | |
| CN | 203910314 U | * | 10/2014 | H01B 7/18 |
| CN | 203963649 U | | 11/2014 | |
| CN | 204407047 U | | 6/2015 | |

* cited by examiner

REINFORCED ELECTRIC WIRE AND METHODS OF MAKING THE SAME

CROSS REFERENCE TO RELATED APPLICATIONS

The present application is a continuation of and claims priority under 35 U.S.C. 120 to U.S. patent application Ser. No. 16/669,991, which was filed on Oct. 31, 2019 which claims priority under 35 U.S.C. 120 to U.S. patent application Ser. No. 15/273,037, which was filed on Sep. 22, 2016 which claims the benefit of U.S. Provisional Patent Application No. 62/272,812, which was filed on Dec. 30, 2015. The entire contents and substance of each of these applications are hereby incorporated by reference in their entirety as if fully set forth herein.

TECHNICAL FIELD

Some embodiments of the present invention relate generally to electric wires and cords, including those used for strings of electric lights, and more particularly, to strings of electric lights used for Christmas decorations.

BACKGROUND

During the Christmas season, strings of electric lights are frequently used for decoration. These strings of electric lights can be subjected to various forces and environmental conditions that can degrade a typical wire. For example, the strings of electric lights may be suspended from rooflines, wrapped around trees, or affixed to other decorative objects. When used for these purposes, electric light strings can be subjected to tensile forces carried in part by the wires in the electric light strings. For this reason, in some cases, it can be desirable or required for the wires to meet certain tensile strength requirements. For example, light strings may be pulled taut while being attached to a roofline. Light strings may also be used to suspend other objects, such as Christmas decorations. Because electric light strings carry electricity, electric light strings need to be able to withstand forces in tension without failing. If a string fails, a customer may be disappointed by the broken light string and may be reluctant to buy that brand of light string in the future. Further, if a string fails, injury can occur due to falling objects or exposure of electric wiring. Wiring used in electric light strings can also be required to meet certain regulatory standards for mechanical or electrical performance to ensure consumer safety. For example, wiring in electric light strings can be required to meet UL standards in the United States. Some of these standards may relate to tensile strength, flammability, melting points, and cold temperature bending, for example.

Electric light strings can comprise a plurality of lamp assemblies connected by one or more wires, and an electrical connector or power plug. Wiring used in strings of electric lights can include an electrical conductor surrounded by an insulator jacket. The electrical conductor can comprise multiple strands of conductive material, such as copper. For example, an ordinary string of incandescent lights can be constructed using #22 AWG wire that contains 16 individual copper strands, and is covered by an insulator jacket made of plastic, such as polyvinyl chloride (PVC).

One way to increase the tensile strength of a wire is to use a thicker wire, such as #20 AWG wiring, or thicker. By doing so, the additional conductive strands or thicker conductive strands can increase the mechanical strength of the wire.

However, the conductive materials used in conductive strands are sometimes too expensive for such an approach to be cost effective. For example, common conductors such as copper or aluminum are commodity materials that can be very expensive. Alternatively, multiple wires can be used to connect lamp assemblies. In some electric light strings, twisted pairs of wires are used to increase the tensile strength of the wire. As with the use of thicker wire, this approach can also sometimes be too expensive.

What is needed, therefore, is a reinforced wire that provides improved tensile strength to prevent breakage and that can be manufactured at relatively low cost. Some embodiments of the present invention address this need as well as other needs that will become apparent upon reading the description below in conjunction with the drawings.

BRIEF SUMMARY

Aspects of the present invention relate to reinforced electric wires, particularly reinforced electric wires as used in holiday lighting such as Christmas light strings. In some embodiments, an electric wire is reinforced with a reinforcing string, which is disposed inside an insulator jacket, and generally parallel to the conductors in the wire. By using a reinforcing string made of a material with a high tensile strength and low cost, the overall tensile strength of the wire can be improved while keeping the cost of manufacturing low.

Some aspects of the present disclosure relate to a reinforced electric wire for use in holiday lighting, the wire comprising a plurality of conductor strands, a plurality of reinforcing threads intermixed with the conductor strands, and an insulator jacket. In some embodiments, the reinforcing threads are not twisted with the conductor strands. In some embodiments, the reinforcing threads are twisted with the conductor strands. In some embodiments, the plurality of reinforcing threads and the plurality of conductor strands form a helical shape within the insulator jacket. In some embodiments, the conductor strands are not substantially wrapped around the reinforcing threads, and the reinforcing threads are not substantially wrapped around the conductor strands. In some embodiments, the channels are separated by insulation material along the entire length of the insulator jacket. In some embodiments, the at least two outer channels are either rotationally symmetric about an axis passing through the center channel or reflectionally symmetric about a plane which intersects an axis passing through the center channel. In some embodiments, the reinforcing strands passing through a first outer channel of the at least two outer channels has a higher tensile strength than the reinforcing strands passing through a second outer channel of the at least two outer channels. In some embodiments, twisting the reinforcing strand and the conductor strands creates a bare electric wire with the reinforcing strands and the conductor strands randomly intermixed.

Some aspects of the present disclosure relate to a method for manufacturing a reinforced electric wire for use in holiday lighting, comprising feeding a first conductor strand through a first hole in an orientation plate of a twisting machine, feeding a reinforcing strand through a second hole in the orientation plate of the twisting machine, wherein the second hole is not coaxial with a twisting axis of the twisting machine, feeding a second conductor strand through a third hole the orientation plate of the twisting machine, wherein the third hole is not coaxial with the twisting axis of the twisting machine, and twisting the reinforcing strand and the conductor strands to create a bare electric wire comprising the reinforcing strand and the conductor strands. In some embodiments, the first hole is a center hole of the orientation plate and is coaxial with the twisting axis of the twisting machine. In some embodiments, the second hole is disposed radially between the first hole and the third hole. In some embodiments, the reinforcing string comprises a polymeric fibrous yarn. In some embodiments, the reinforcing string comprises a conductive material having a higher resistivity than the conductor. In some embodiments, the reinforcing string is made of a material selected from the group consisting of nylon, polyester, polypropylene, rayon, Polyparaphenylene terephthalamide, or mixtures thereof.

Some aspects of the present disclosure relate to a light string comprising a first wire comprising a first plurality of conductor strands, a first plurality of reinforcing threads intermixed with the first plurality of conductor strands, and an first insulator jacket, a second wire comprising a second plurality of conductor strands, a second plurality of reinforcing threads intermixed with the second plurality of conductor strands, and a second insulator jacket, a lamp assembly electrically connected to the first wire and the second wire. In some embodiments, the first plurality of reinforcing threads are randomly intermixed with the first plurality of conductor strands. In some embodiments, the second plurality of reinforcing threads are randomly intermixed with the second plurality of conductor strands.

The foregoing summarizes only a few aspects of the present invention and is not intended to be reflective of the full scope of the present invention. Additional features and advantages of the present invention are set forth in the following detailed description and drawings, may be apparent from the detailed description and drawings, or may be learned by practicing the present invention. Moreover, both the foregoing summary and following detailed description are exemplary and explanatory and are intended to provide further explanation of the presently disclosed invention as claimed.

BRIEF DESCRIPTION OF THE FIGURES

The accompanying drawings, which are incorporated in and constitute a part of this specification, illustrate multiple embodiments of the presently disclosed subject matter and serve to explain the principles of the presently disclosed subject matter. The drawings are not intended to limit the scope of the presently disclosed subject matter in any manner.

DETAILED DESCRIPTION

Figure 1:
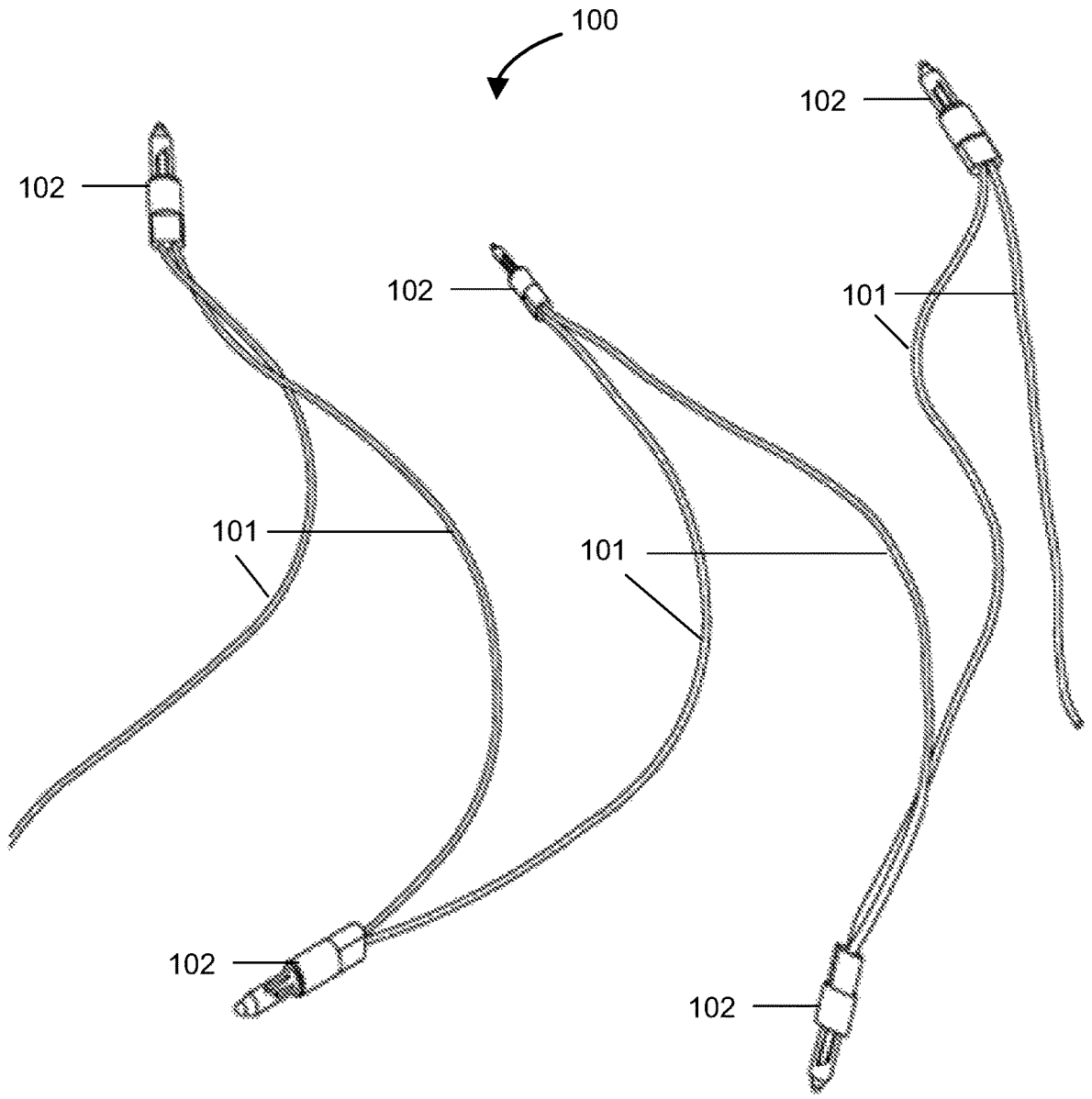
FIG. 1 depicts a portion of a light string in accordance with an embodiment of the present disclosure.

Aspects of the disclosed technology relate to reinforced wires, and more particularly to reinforced wires for use in holiday electric lighting strings. In some embodiments, an electric wire is reinforced with a reinforcing string or reinforcing thread, which can be disposed inside an insulator jacket, and generally parallel to the conductors in the wire. By using a reinforcing string made of a material with a high tensile strength and low cost, the overall tensile strength of the wire can be improved while keeping the cost of manufacturing low.

Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It should also be noted that, as used in the specification and the appended claims, the singular forms "a," "an" and "the" include plural references unless the context clearly dictates otherwise. References to a composition containing "a" constituent is intended to include other constituents in addition to the one named.

Also, in describing the preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/ or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" may be used herein to connote different aspects of methods employed, the term should not be interpreted as implying any particular order among or between various steps herein disclosed unless and except when the order of individual steps is explicitly required.

The components described hereinafter as making up various elements of the invention are intended to be illustrative and not restrictive. Many suitable components that would perform the same or similar functions as the components described herein are intended to be embraced within the scope of the invention. Such other components not described herein can include, but are not limited to, for example, similar components that are developed after development of the presently disclosed subject matter.

To facilitate an understanding of the principles and features of the invention, various illustrative embodiments are explained below. In particular, the presently disclosed subject matter is described in the context of electric light strings. The present invention, however, is not so limited, and can be applicable in other contexts. For example and not limitation, some embodiments of the present invention may improve electric wiring used in consumer and industrial environments, or any context where improved mechanical strength is beneficial. These embodiments are contemplated within the scope of the present invention. Accordingly, when the present invention is described in the context of decorative electric light strings, it will be understood that other embodiments can take the place of those referred to.

The present disclosure relates to reinforced wires and cords used for carrying electric current. Some embodiments are particularly suited for use in holiday lighting applications, such as electric light strings. FIG. 1 depicts several segments of a reinforced wire 101 in accordance with an embodiment connected to a plurality of lamp assemblies 102. In some embodiments, the addition of a reinforcing string increases the tensile strength of the wire. This increased tensile strength can make the wire safer for end users, and can enable the wire to pass regulatory standards, such as UL standards.

In some embodiments, a reinforced wire comprises at least three components—a conductor, a reinforcing string, and an insulator jacket. The conductor primarily carries an electric current across the length of the reinforced wire, although it may contribute to the tensile strength of the reinforced wire as well. The reinforcing string primarily enhances the tensile strength of the reinforced wire. In some embodiments, the reinforcing string can be an insulating material. In some embodiments, the reinforcing string can be at least partially conductive, and thus may contribute to carrying an electric current. The reinforced wire can comprise one or more reinforcing strings, as may be required in particular applications for various reasons, such as increasing tensile strength. The insulator jacket primarily protects the wire from, for example and not limitation, corrosion and shorts, and helps to prevent electric shocks, although the insulator jacket may also contribute to the tensile strength of the wire.

Some aspects of the present invention may also include electric wires where the conductor is a single conductive strand, or a plurality of conductive strands. As would be recognized by persons having ordinary skill in the art, the selection of a wire having a single conductor strand or a plurality of conductive strands is based at least on the desired mechanical properties—such as resistance to, or resilience under bending forces—or desired electrical properties—such as selecting a current carrying capacity suitable for the intended application of the wire. Whether a single or a plurality of conductive strands is selected, the methods and systems for reinforcing the wire are generally the same, as would be recognized by a person of ordinary skill in the art.

Figure 2:
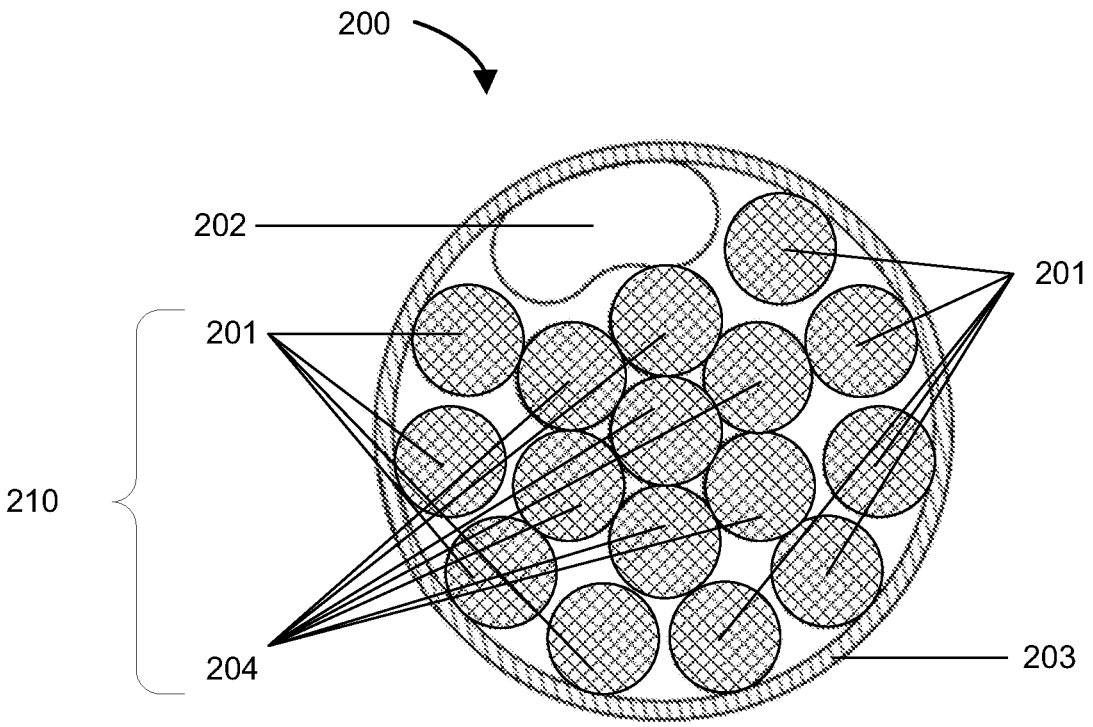
FIG. 2 depicts a cross-section of a reinforced wire in accordance with an embodiment having a plurality of conductor strands.

FIG. 2 depicts a cross-section of a reinforced wire in accordance with an embodiment having a plurality of conductor strands. In some embodiments, the reinforced wire 200 includes a conductor 210 having a plurality of conductor strands 201, 204, a reinforcing string 202 adjacent to the conductor, and an insulator jacket 203 in contact with, and at least partially surrounding the reinforcing string and conductor. The conductor strands 201, 204 can be configured in a several arrangements, such as that shown in FIG. 2. In some embodiments, some conductors are inner conductors 204, in that they are disposed closer to the long axis of the wire than outer conductor strands 201. In some embodiments, the inner conductors 204 are not in physical contact with the insulator jacket 203. In some embodiments, the reinforced wire contains only a single inner conductor 204. In addition, as shown, the reinforcing string 202 can be located on an outside region of the conductor. More specifically, a plurality of the outer conductor strands 201 can be disposed around an outside perimeter of the wire (as shown in FIG. 2), except in the location where the reinforcing string 202 is disposed. In some embodiments, when viewed in cross-section, the outer conductor wires form approximately a circle, having a gap between at least two outer conductor strands 202. The reinforcing string 202 can then be disposed within the gap. In this manner, in some embodiments, the reinforced wire can have an overall cross-section that is approximately circular. In some embodiments, the reinforcing string 202 can take the place of one or more conductor strands 201 around the outside of the perimeter of the conductor. Alternatively, a plurality of the conductor strands 201 can be disposed around the entire outside perimeter of the wire, and the reinforcing string 202 can be disposed adjacent to the conductor strands 201. In another embodiment, the reinforcing string 202 can be disposed interior to the conductor strands 201.

Figure 3:
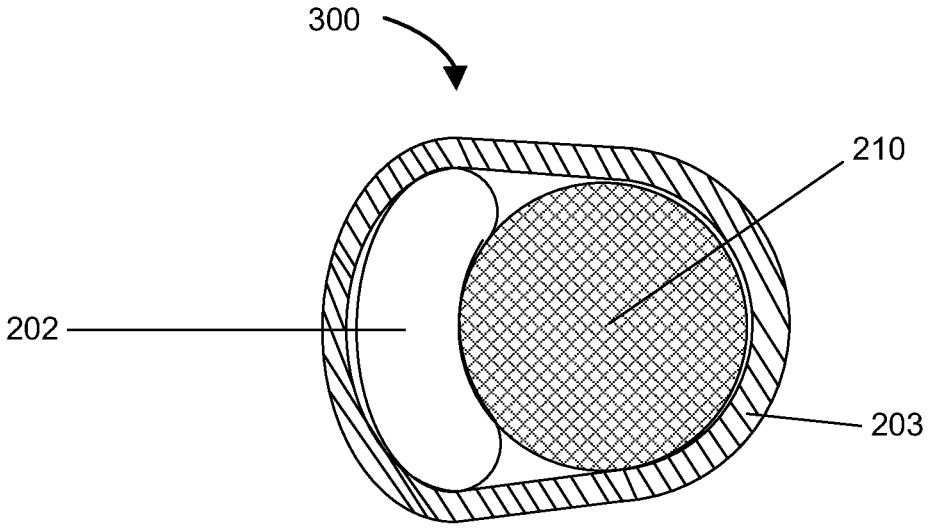
FIG. 3 depicts a cross-section of a reinforced wire in accordance with an embodiment having a single conductor strand.

FIG. 3 depicts a cross-section of a reinforced wire in accordance with an embodiment having a single conductor strand. In some embodiments, the reinforced wire 300 comprises a conductor comprising a single conductor strand 201, a reinforcing string 202 adjacent to the conductor, and an insulator jacket 203 in contact with, and at least partially surrounding the reinforcing string and conductor.

As will be understood by those of skill in the art, some aspects of the present invention relate to electric wires, or electric cords. Electric wires are elongate conductors with a single conductive path—all conductor strands are in electrical communication with each other over the length of the wire. This is in contrast with electric cords, which are elongate conductors with at least two conductive paths, each conductive path not in electrical communication with each other over the length of the cord. It should be noted that "electrical communication" as used herein to describe conductor strands within a wire or cord does not refer to electrical communication through a resistive load separate from the conductor or conductors that form a part of the wire or cord (including any conductive reinforcing string or strings), such as a lamp or other device for receiving electric power or electric signals. While some aspects of the present disclosure relate to electric wires, persons having ordinary skill in the art will recognize that the reinforcement systems discussed herein could likewise be applied to electric cords.

Some aspects of the presently disclosed technology include embodiments where a plurality of conductor strands 201 is twisted to form the conductor. In some of these embodiments, the reinforcing string 202 is twisted with the conductor strands 201, such as on a twisting machine. In some of these embodiments, the reinforcing string 202 is placed in parallel to the conductor strands 201, and not twisted. For example, a twisted bundle of conductor strands 201 may be co-extruded through an insulating machine with the reinforcing string 202 to create a reinforced wire. Further, in some embodiments, neither the plurality of electric conductors 201 nor the reinforcing string 202 are twisted. Instead, all are substantially parallel along the length of the reinforced wire.

Figure 4:
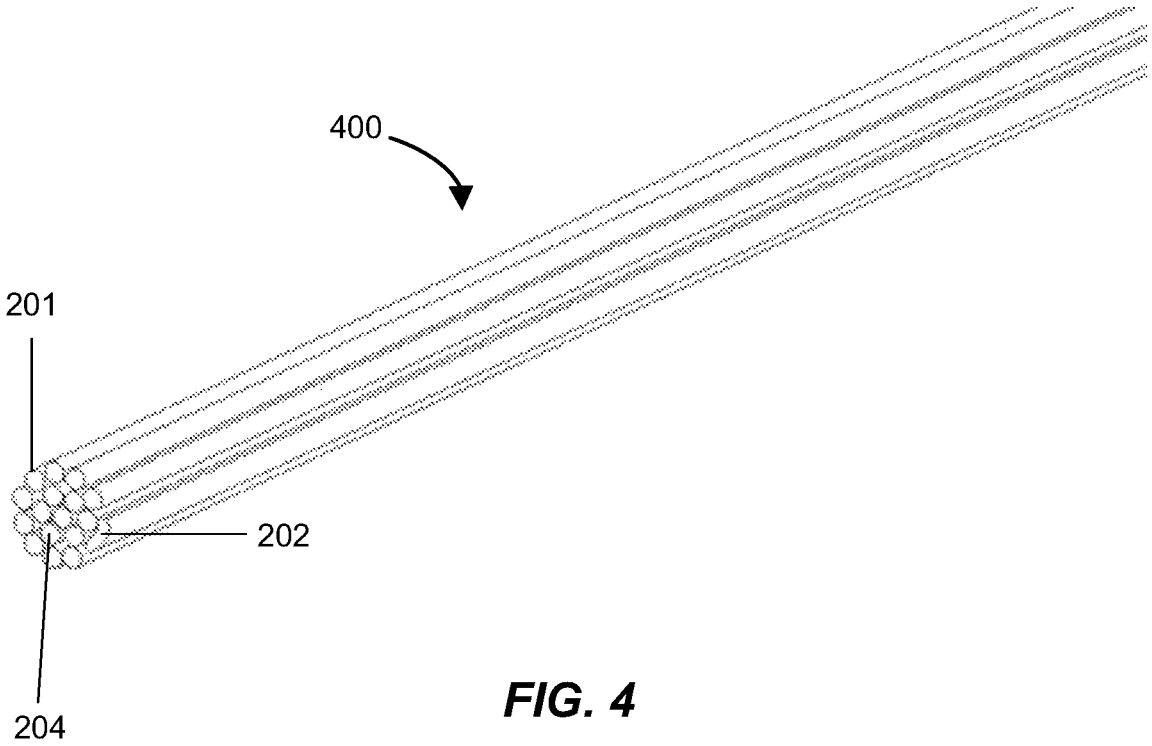
FIG. 4 depicts a reinforced wire in accordance with an embodiment having a reinforcing string substantially parallel to a length of the reinforced wire. The insulator jacket is omitted for ease of viewing.
Figure 5:
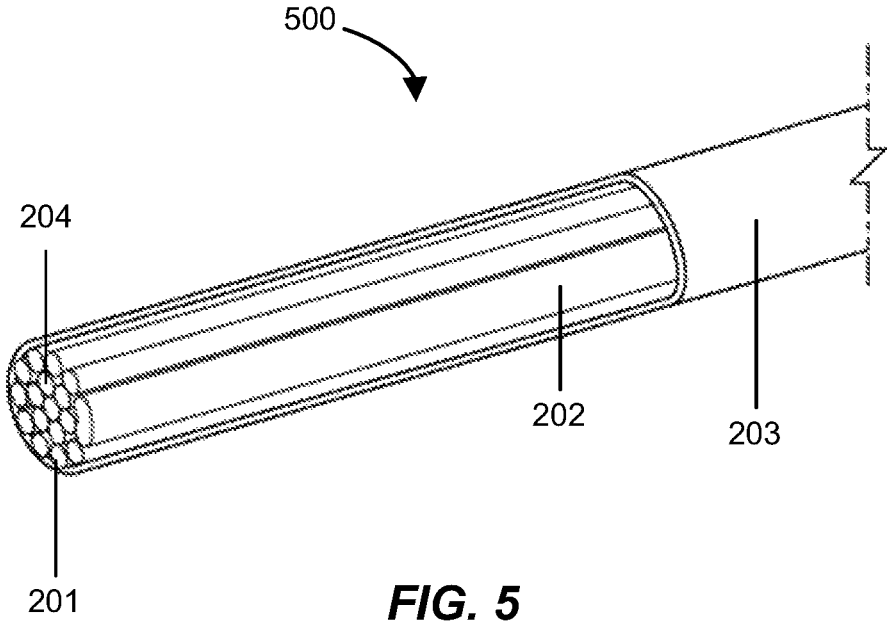
FIG. 5 depicts a cut-away view of a reinforced wire in accordance with an embodiment having a string substantially parallel to a length of the reinforced wire.

FIG. 4 depicts an example of an embodiment of a wire 400 wherein the conductor strands 201 and the reinforcing string 202 are parallel, and not twisted. For clarity, the insulator jacket is omitted from FIG. 4, however it is understood that an insulator jacket could be added to the conductor and reinforcing strands depicted in FIG. 4. In some embodiments, the reinforcing string 401 and the conductor strands 202 are substantially parallel to an axis parallel to a length of the reinforced electric wire. FIG. 5 depicts the wire of FIG. 4 with an insulation jacket 203 encompassing a plurality of conductors 201 and reinforcing string 202, in accordance with an embodiment.

Figure 6:
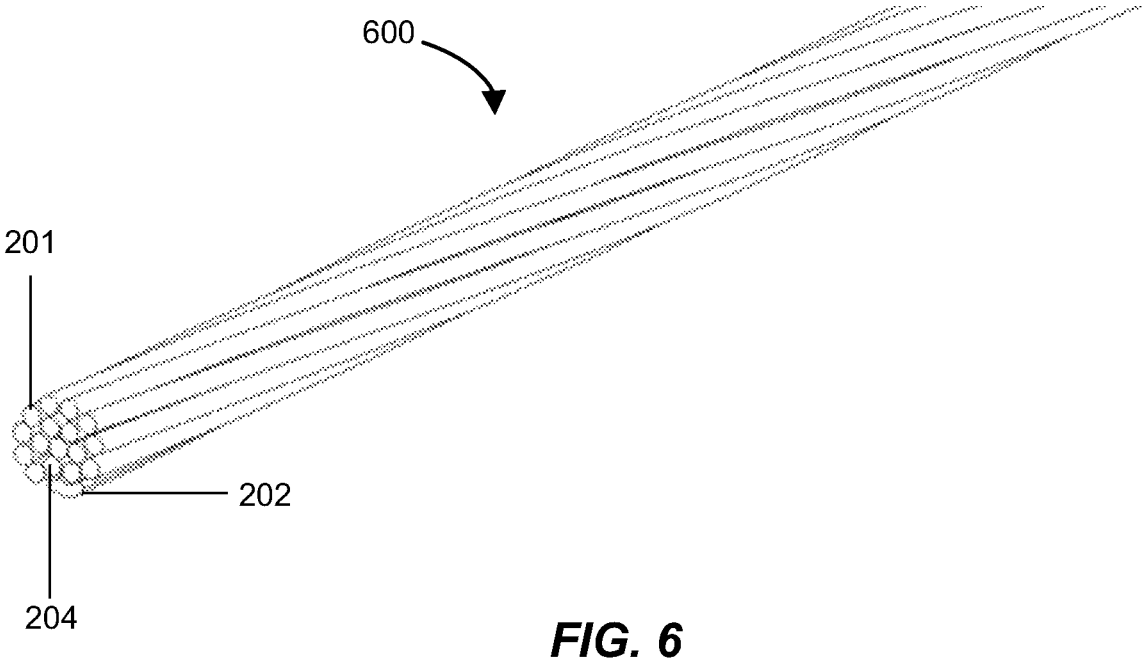
FIG. 6 depicts an embodiment where the conductor and reinforcing string are twisted about an axis parallel to a length of the reinforced wire. The insulator jacket is omitted for ease of viewing.
Figure 7:
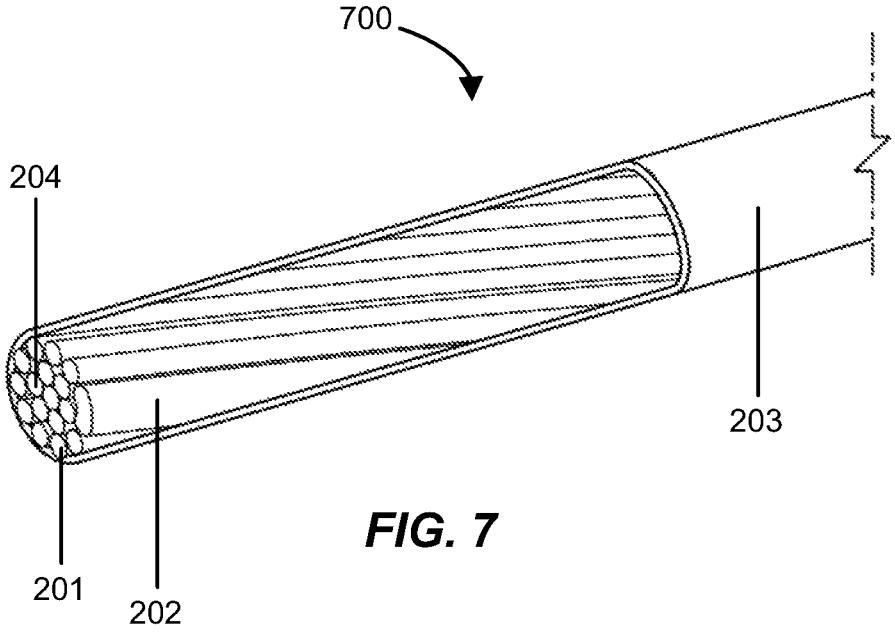
FIG. 7 depicts a cut-away view of a reinforced wire in accordance with an embodiment where the conductor and reinforcing string are twisted about an axis parallel to a length of the reinforced wire.

FIG. 6 depicts an example of an embodiment of a wire 600 wherein the conductor strands 201 and the reinforcing string 202 are twisted about an axis parallel to a length of the wire. For clarity, the insulator jacket is omitted from FIG. 6, however it is understood that an insulator jacket could be added to the conductor and reinforcing strands depicted in FIG. 6. FIG. 7 depicts the wire of FIG. 6 with an insulation jacket 203 encompassing a plurality of conductors 201 and reinforcing string 202, in accordance with an embodiment.

Figure 8:
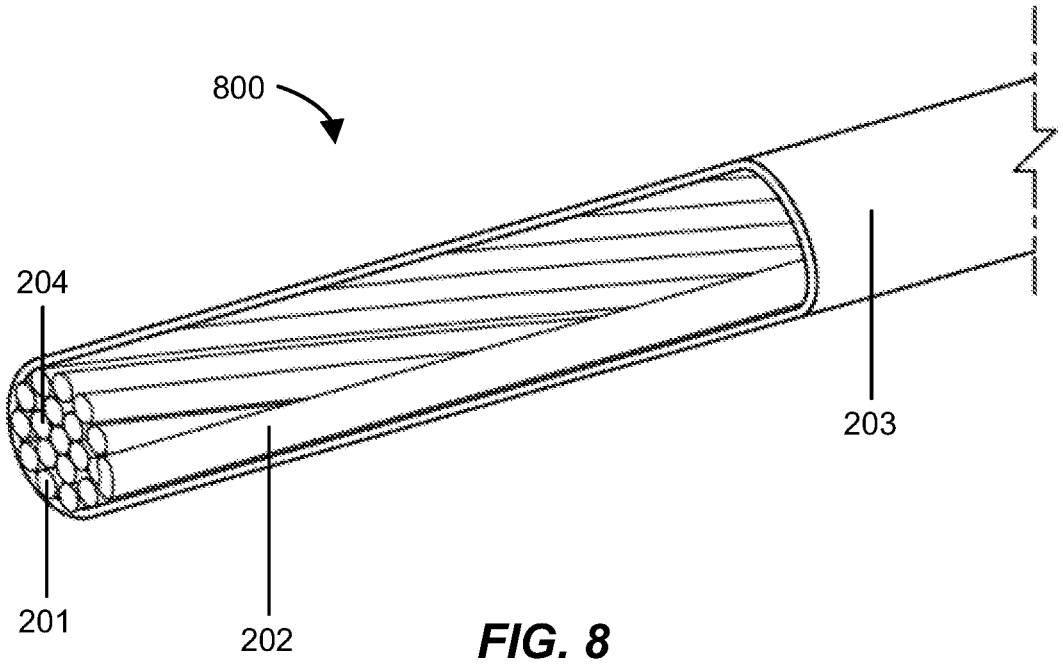
FIG. 8 depicts a cut-away view of a reinforced wire in accordance with an embodiment where the conductor is twisted about an axis parallel to a length of the reinforced wire, and the reinforcing string is parallel to the length of the reinforced wire.

FIG. 8 depicts an example of an embodiment of a wire 800 wherein the conductor strands 201 are twisted about an axis parallel to the length of the wire, and the reinforcing string 202 is parallel to the twisted bundle of conductor strands 201. The twisted conductor strands 201 and reinforcing string 202 are additionally encompassed by an insulator jacket 203.

Figure 9:
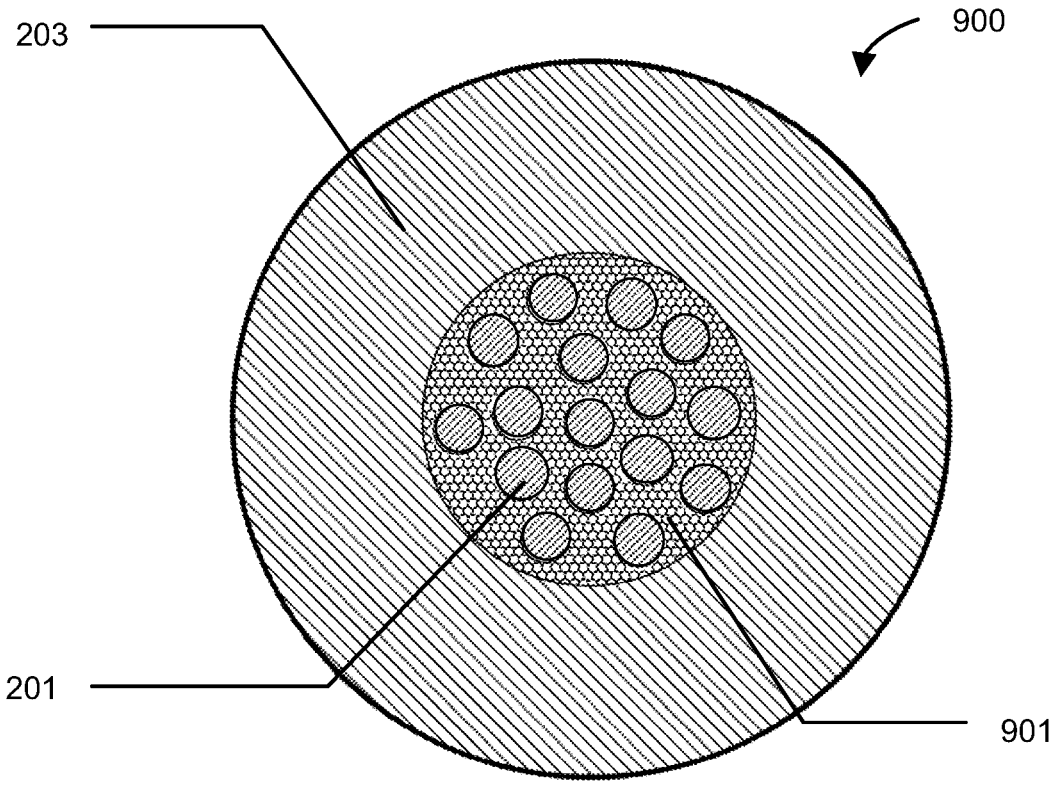
FIG. 9 depicts a cross-section of a reinforced wire in accordance with an embodiment, where the conductor strands are interspersed with the reinforcing threads.
Figure 12:
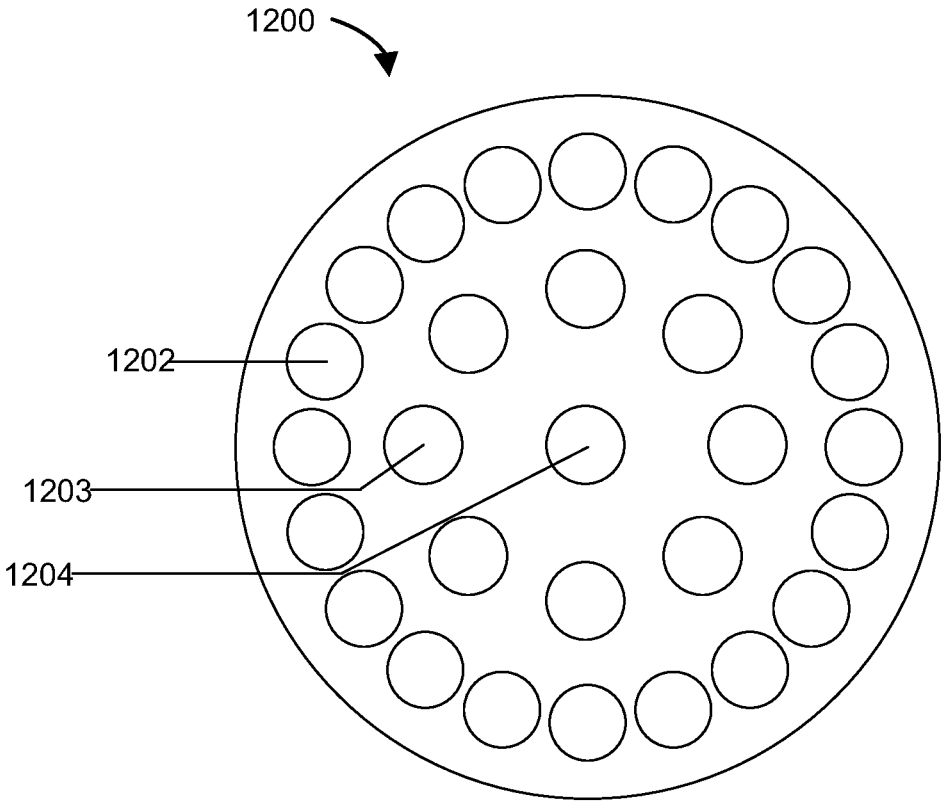
FIG. 12 depicts an orientation plate for use in making reinforced wires in accordance with an embodiment.

FIG. 9 is a cross-section of an embodiment wherein the conductor strand or strands 201 are intermixed with reinforcing threads 901. Here, the reinforcing string 202, which is made of a plurality of reinforcing threads 901, is spread throughout the wire, intermixing conductive strands and reinforcing threads. In some embodiments intermixing conductor strands 201 and reinforcing threads 901 can be accomplished by drawing the two through a single hole in an orientation plate as shown in FIG. 12 (discussed below). In some embodiments, the intermixed reinforcing threads 901 are distributed at random around the conductor strands 201. In some embodiments, the intermixed reinforcing threads 901 are distributed asymmetrically around the conductor strands 201. In some embodiments, the location within the cross section of conductor strands 201 and reinforcing threads 901 can change, as the conductor strands 201 and reinforcing threads 901 intermix along the length of the wire. In some embodiments, the specific orientation or arrangement of the reinforcing threads 901 and conductor strands 201 are random and not essential to the disclosed technology. In general, reinforcing strands 202 are thicker than reinforcing threads 901, however, the materials that can be used for reinforcing strands and reinforcing threads are the same. Reinforcing strands 202 may comprise a plurality of reinforcing threads 901. For example, where yarn is used as a reinforcing strand 202, it may comprise a plurality of threads. As would be recognized by a person of ordinary skill in the art, reinforcing strands 201 can be substituted for one or more reinforcing threads 901, and one or more reinforcing threads 901 can be substituted for a reinforcing strand 201. Embodiments of the presently disclosed technology which use reinforcing strands 201 can be implemented by substituting reinforcing threads 901, and embodiments using reinforcing threads 901 can be implemented by substituting a reinforcing strand 201.

In some embodiments, the reinforcing strands may be substantially surrounded by conductive strands, or may be commingled together within the insulator jacket 203. In some embodiments, the reinforcing threads 901 and conductor strands 201 are twisted together. In some embodiments, the reinforcing threads 901 are substantially parallel to the conductor strands 201, or are not twisted around, within, or with the conductor strands 201. In some embodiments, the reinforcing threads 901 and conductor strands 201 are twisted together. In these embodiments, the reinforcing threads 901 and conductor strands 201 each form a helical shape within the insulator jacket. Further, in these embodiments, the conductor strands 201 are not substantially wrapped around the reinforcing threads 901, nor are the reinforcing threads 901 substantially wrapped around the conductor strands 201.

Figure 10:
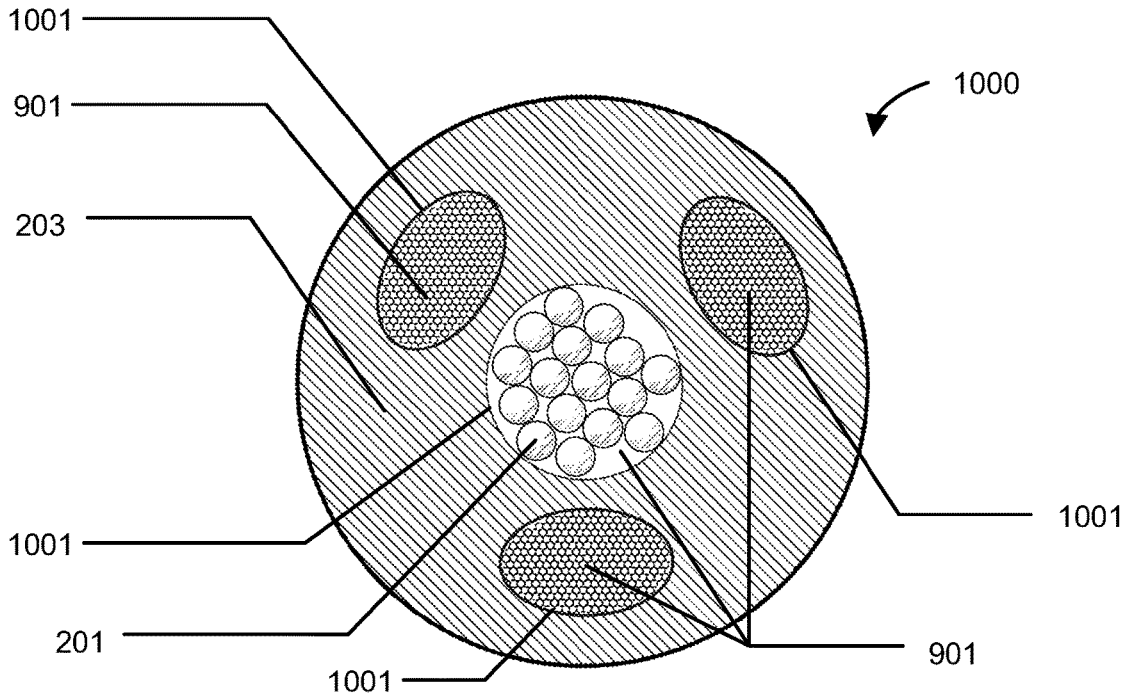
FIG. 10 depicts a cross-section of a reinforced wire in accordance with an embodiment, where there are channels in the insulator jacket, a plurality of conductive strands is passed through a center channel, and reinforcing threads are passed through the other channels.

FIG. 10 is a cross-section of an embodiment comprising a plurality of channels 901 within the insulator jacket 203. In some embodiments a plurality of channels 1001 may be provided in an insulator jacket, with the conductor strands 201 disposed in one or more channels 1001, and the reinforcing threads 901 disposed in one or more channels 1001 that can optionally be different channels. Each channel is entirely contained by the insulator jacket 203 (when viewed in cross-section), and the reinforcing threads 901 or conductor strands 201 in one channel are not in physical contact with the reinforcing threads 901 or conducing strands 201 in one or more different channels 1001. In some embodiments, the reinforcing threads 901 may be disposed in two, three, four, or more channels 1001. In some embodiments, the number of reinforcing threads 901 can vary between the channels—i.e. one channel may have ten reinforcing threads, another five, and another eight. In some embodiments, the channels 1001 containing the reinforcing threads 901 may be arranged in a ring around the channel 1001 containing the conductor strands 201. In some embodiments, the channels 1001 containing the reinforcing threads 1001 may be arranged in a configuration that is either reflectionally symmetric about a plane that intersects a line passing through the center of the wire, or rotationally symmetric about an axis passing through the wire, such as, for example, the center of the wire. Such symmetry in arrangement can enhance the wire's resilience under and/or resistance to bending. In some embodiments, one or more channels 1001 may contain both reinforcing threads 901 and conductor strands 201. As would be understood by persons having ordinary skill in the art, numerous other selections of the number, arrangement, and contents of the channels could be selected, all of which are encompassed by the present disclosed technology. Further, though described in relation to reinforcing threads 901, it is understood that the channels could also include reinforcing strings 202, which can comprise reinforcing threads 901.

Figure 11:
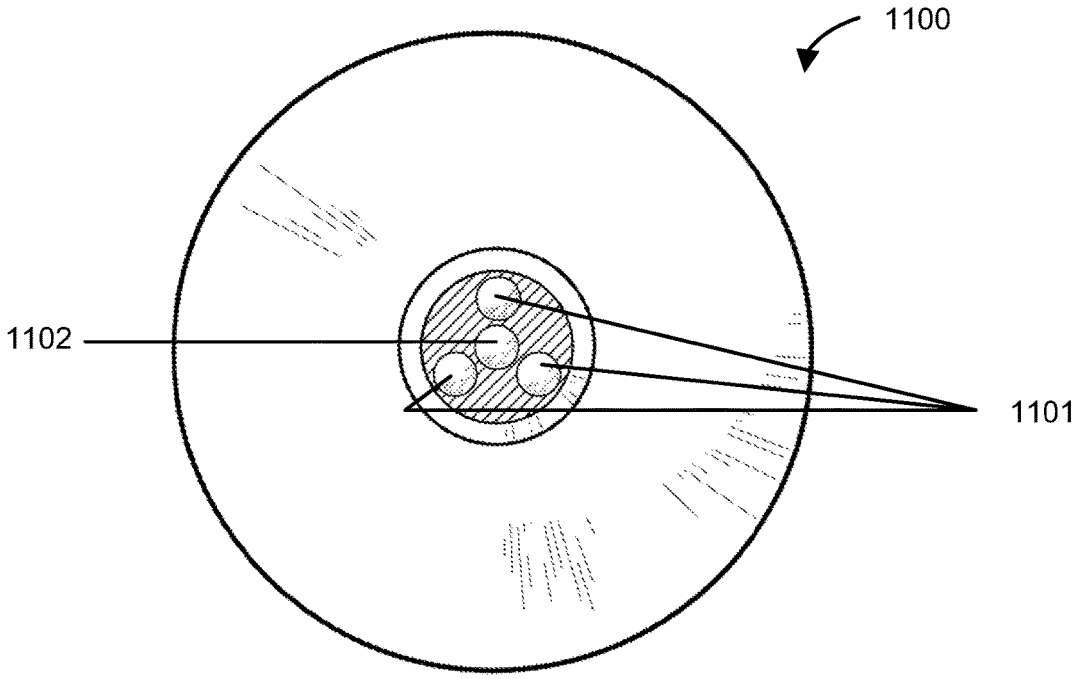
FIG. 11 depicts a die for making a reinforced wire in accordance with an embodiment, used for extruding an insulator jacket over a wire having four channels.

In some embodiments, the bare electric wire is coated with an insulator jacket (e.g., insulator jacket 203) using an extrusion machine. Extrusion machines typically consist of an insulation material feed system, a heater, and a die or mold for the extrusion process. FIG. 11 depicts a die 1100 in accordance with an embodiment. The die 1100 is generally conically shaped, with the top of the cone cut flat, and one or more openings 1101, 1102 in the top of the cone. In some embodiments, the die 1100 may comprise only a single hole 1102, such as is used when the reinforcing strands are twisted with the conductor strands. Each hole, or opening 1101, 1102 produces a hollow channel in the insulation material as it is drawn around the die, and one or more strands (conducting or reinforcing) may be passed through the opening, causing those strands to be disposed within the channel caused by the respective hole. For example, the embodiment shown in FIG. 10 can be produced using a die having four holes—one in the middle 1102, and three in a ring 1101 around the middle 1102. One or more reinforcing strands is passed through each of holes 1102, and one or more conductor strands is passed through center hole 1101, while insulation material is extruded over the die 1100. The result is an insulated wire in accordance with an embodiment, having the cross section depicted in FIG. 10.

Some embodiments of the present invention can be manufactured using equipment ordinarily used for producing stranded electric wiring. Such equipment typically comprises a plurality of spools of wire strands, such as narrow-gauge copper filaments. Each of these spools is located on a spindle, and the strands on each spool are drawn through a hole in an orientation plate 1200 connected to the spindle, as shown in FIG. 12. An orientation plate may have a plurality of holes 1202, 1203, 1204. In some embodiments, an orientation plate may have holes arranged in a series of concentric circles, with a center hole 1204, and a first ring of holes 1203, and a second ring of holes 1202, as shown in FIG. 12. As the wire is drawn, and the spindle is rotated, each of the strands can be wrapped around each other, producing a twisted, stranded wire. In embodiments where this manufacturing process is used, a reinforcing string can be run through any of the plurality of holes. In an embodiment, a conductor strand is passed through center hole 1204, reinforcing strands passed through holes in the first ring 1203, and additional conductors passed through holes 1202. In some embodiments, all the holes in an orientation plate may be used, or only a subset thereof. For example, in some embodiments, all conductor strands and reinforcing strands can be passed through the center hole 1204. In some embodiments a single conductor strand or single reinforcing strand can be passed through any of the used holes 1202, 1203, 1204. In some embodiments, a plurality of conductor strands or reinforcing strands can be passed through any of the used holes 1202, 1203, 1204.

Figure 13:
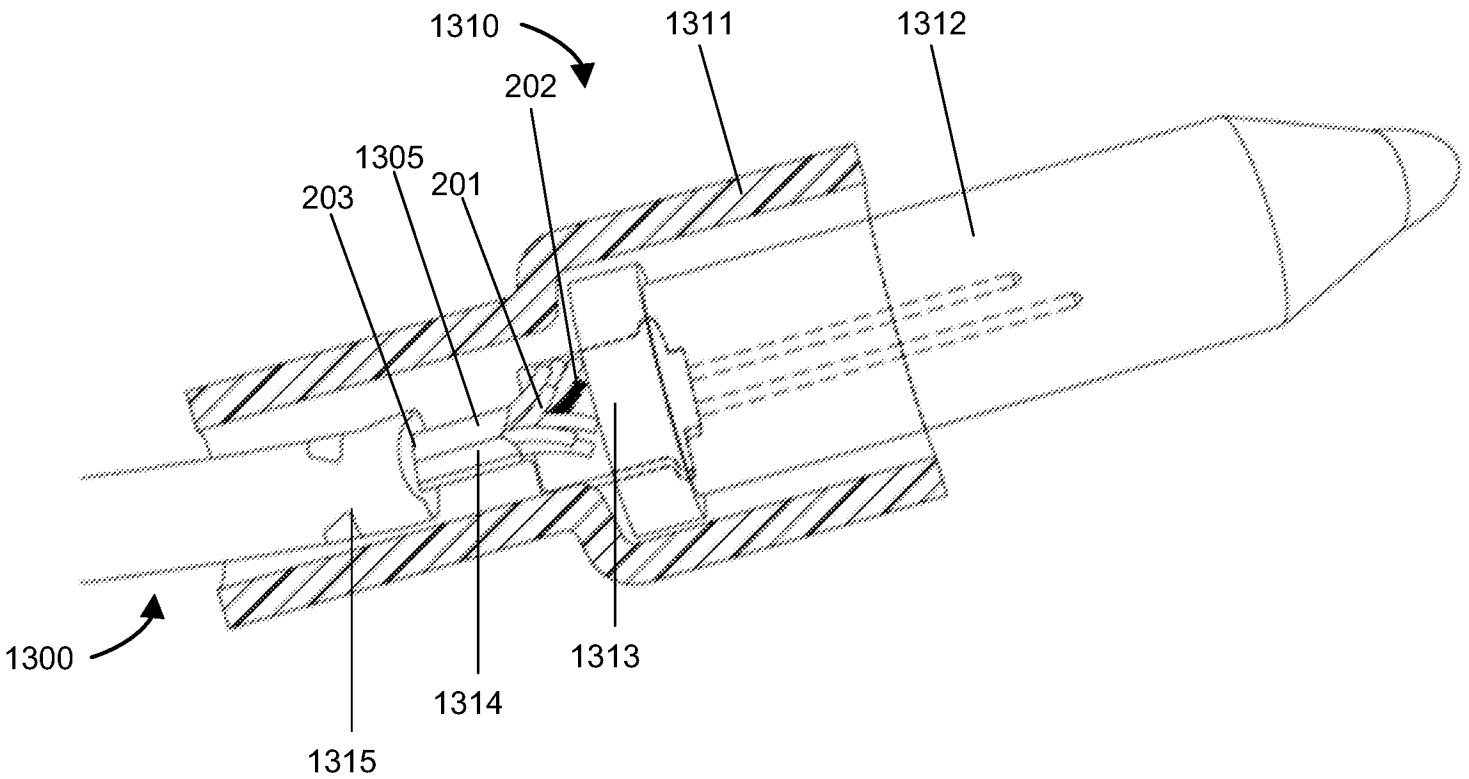
FIG. 13 depicts a lamp assembly coupled to a reinforced wire in accordance with an embodiment.

FIG. 13 depicts an embodiment of a reinforced wire 1300 connected to a lamp assembly 1310 similar to the kind used in holiday decorations, such as Christmas light strings. The lamp assembly can comprise a lamp holder 1311, lamp 1312, and crimp connector 1313. A reinforced wire 1300 is connected to the lamp assembly 1310 by stripping a portion of the insulator jacket 203 from the end of the reinforced wire 1300, exposing a portion of the plurality of conductor strands 201 and reinforcing string 202 (depicted in black, for clarity and not limitation). The exposed end is then crimped to crimp connector 1313 by folding over one or more flanges 1314 over the exposed conductor 202 and reinforcing string 1302. Crimp connector 1313 connects the reinforcing string and the conductor strands to the lamp assembly, and allows tensile forces applied to the lamp assembly to be transferred to the reinforced wire. In some embodiments a reinforced wire 1300 can be additionally connected to lamp assembly 210 by an additional set of flanges 215 crimped around the insulator jacket, providing additional strength in the connection between the lamp assembly 1310 and the reinforcement wire 1300. In some embodiments, the conductor strands 201 and reinforcing string 1302 can be crimped together by a single crimp connector 1313, while in others, the conductor strands 201 and reinforcing string 130 can be crimped separately in two different crimp connectors 1313.

Figure 14:
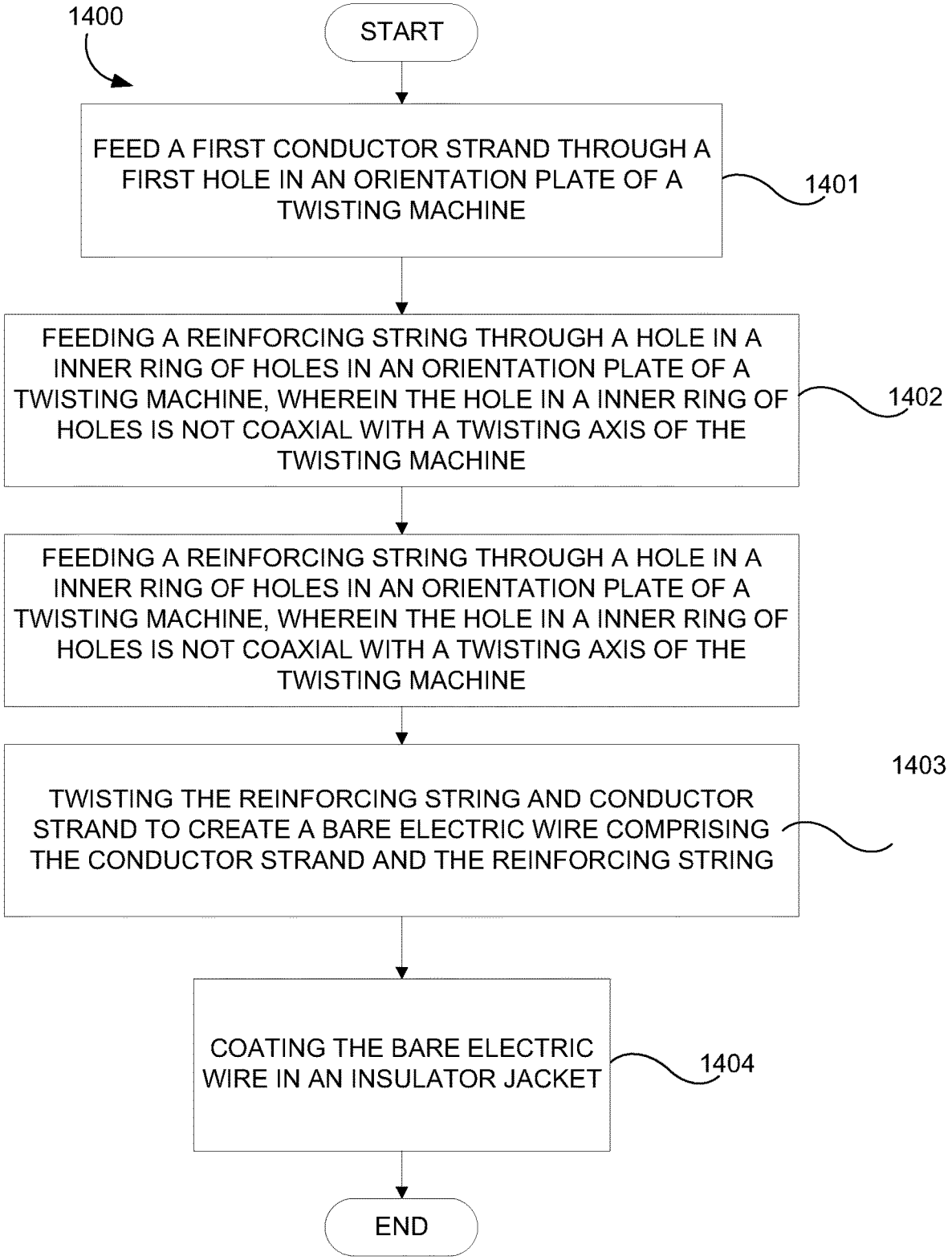
FIG. 14 is a flow diagram showing a method of fabricating a reinforced wire using a twisting machine in accordance with an embodiment.

FIG. 14 depicts an example of a manufacturing process 1400 for producing an embodiment. Manufacturing process 1400 begins with feeding a conductor strand 201 through a first hole (e.g. 1202) in an orientation plate 1200 of a twisting machine. In some embodiments, a plurality of conductor strands 201 can be fed through one or more holes in an orientation plate. Each conductor strand can be fed through a separate hole in the orientation plate, or a plurality of conductor strands can be fed through a single hole. Next, or concurrently, a reinforcing string 202 can be fed through a second hole in an orientation plate of a twisting machine. In some embodiments, the second hole is not coaxial with a twisting axis of the twisting machine, or is not the center hole 1204. By using a hole not coaxial with the twisting axis of the twisting machine or a hole that is not the center hole 1204, the reinforcing string 202 is disposed on the outside of the bundle of conductor strands 201 and the reinforcing string 202. Then, the twisting machine can be used to twist the conductor strand, or plurality of conductor strands together with the reinforcing string to produce a bare electric wire 1403. This produces a bare wire having reinforced properties. In some embodiments, a conductive strand 201 may be passed through center hole 1204, and reinforcing strings 202 passed through a plurality of holes in the first ring 1203. In some embodiments, additional conductive strands 201 may be passed through a plurality of holes in the third ring 1202. Optionally, the bare electric wire produced by this method may be coated in an insulator jacket 1404 to produce a reinforced wire in accordance with an embodiment.

Figure 15:
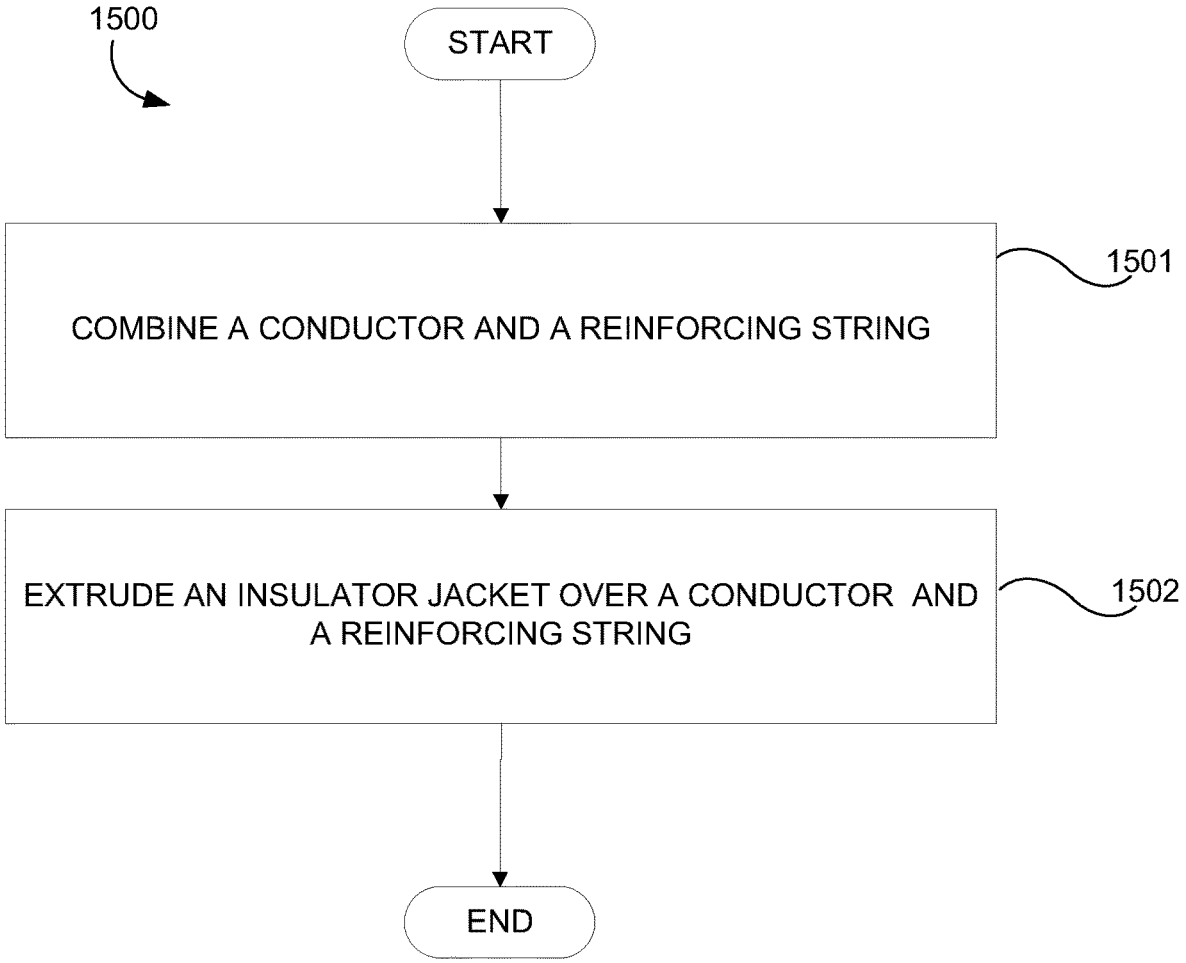
FIG. 15 is a flow diagram showing a method of fabricating a reinforced wire via a coextrusion process in accordance with an embodiment.

FIG. 15 depicts another method of manufacturing an embodiment. In methods in accordance with FIG. 15, the manufacturing process 1500 can begin with a conductor from any source. The conductor 210 may comprise a single conductor strand 201, or a plurality of conductor strands 201. Where the conductor comprises a plurality of conductor strands 201, the conductor strands 201 may be twisted together, as shown in FIG. 6, or may be parallel, as shown in FIG. 4. The manufacturing process can include combining a conductor and a reinforcing string 1501 and co-extruding an insulator jacket over the conductor and a reinforcing string 1502, producing a reinforced wire in accordance with an embodiment. This co-extrusion of the reinforcing string 202 with the one or more conductor strands 201 and the insulator jacket 203 may be performed by an extrusion machine, as is known in the art and applied to non-reinforced electric wires.

Embodiments of the present disclosed technology can be made of a variety of materials, as would be understood by one having ordinary skill in the art. Some embodiments may be made of specific materials, as indicated herein, however other materials are also contemplated.

In some embodiments, the conductor strands 201 are made of copper. In some embodiments, the conductor strands 201 are made of aluminum or steel. In one non-limiting example, the plurality of conductor strands 201 can comprise sixteen (16) copper strands. In some embodiments, a conductor strand 201 can provide a portion of the tensile strength of the overall wire. In some embodiments having a plurality of conductor strands 201, all conductor strands 201 are in electrical communication with all other conductor strands 201.

In some embodiments, the reinforcing string 202 can be made of nylon, polyester, polypropylene, rayon, Poly-para-phenylene terephthalamide (marketed as Kevlar®), or mixtures thereof. In some embodiments, the reinforcing string 202 can be made of any polymeric fibrous yarn known in the art, or mixtures thereof. In some embodiments the reinforcing string 202 can be a yarn, such as a flat continuous filament yarn. In some embodiments, the reinforcing string 202 can comprise a plurality of reinforcing threads made of a similar material. In some embodiments the reinforcing string 202 can comprise steel strands, or copper clad steel wire. In some embodiments, the reinforcing string 202 can be made of a metallic material. In some embodiments, the reinforcing string 202 comprises a single filament. In some embodiments, the reinforcing string 202 comprises a plurality of filaments.

In some embodiments, the reinforcing string 202 is non-conductive. In some embodiments, the reinforcing string 202 can be conductive. Where the reinforcing string 202 is conductive, the reinforcing string 202 carries less amperage than all conductor strands present within the wire. This can be, for example, because the conductive reinforcing strand 202 has a higher resistivity than the conductor strands 201. This higher resistivity can be caused by using a material for the reinforcing string 202 with a lower material conductivity, or by electrically insulating the reinforcing string 202 from the conductor strands 201. This electrical insulating may be done by, for example, oxidizing the reinforcing string, or coating the reinforcing string with an insulator material.

In some embodiments, a reinforced wire can be coated in an insulator jacket 203. The insulator jacket 203 can surround the conductor and reinforcing string. The insulator jacket 203 serves to prevent shorting, and permit safe use of the reinforced wire in, for example, holiday lighting applications. The insulator jacket 203 can comprise any material known and used in the art for wire insulation. In some embodiments, the insulator jacket 203 can be made of polyvinyl chloride (PVC). In some embodiments, the insulator jacket 203 can be made of a plastic, such as PVC, semi-rigid PVC, plenum PVC, polyethylene, polypropylene, polyurethane, chlorinated polyethylene, Nylon, and mixtures thereof. In some embodiments, the insulator jacket 203 can be made of a rubber, such as thermoplastic rubber, polychloroprene (Neoprene), styrene butadiene rubber, silicone, fiberglass, ethylene propylene rubber, rubber, chlorosulfonated polyethylene, ethylene propylene diene monomer, and mixtures thereof. In some embodiments, the insulator jacket 203 can be made of a fluoropolymer, such as PFA, polytetraflouroethylene, fluorinated ethylene propylene, ETFE Tefzel and ECTFA Halar, polyvinylidene fluoride, thermoplastic elastomers, and mixtures thereof. In some embodiments, the insulator jacket 203 can be made of a mixture of a plastic, rubber, or fluoropolymer as described above, and one or more plasticizers, stabilizers, mineral fillers, lubricants, and other additives as is known in the art.

While the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An artificial tree comprising:

a first trunk section including:

a first plurality of branches pivotally connected to the first trunk section;

a light set distributed on a first branch and a second branch of the plurality of branches, the light set including a plurality of lamp assemblies;

a plurality of reinforced wires electrically connecting the plurality of lamp assemblies, the plurality of reinforced wires comprising:

a first wire comprising:

a first plurality of conductor strands;

a first plurality of reinforcing threads, each reinforcing thread of the first plurality of reinforcing threads being disposed in a respective gap of a first plurality of gaps, each respective gap of the first plurality of gaps disposed between at least two conductors of the first plurality of conductors; and a first insulator jacket covering the first plurality of conductor strands and the first plurality of reinforcing threads and in contact with a subset of the first plurality of conductor strands and a subset of the first plurality of reinforcing threads; and a second wire comprising:

a second plurality of conductor strands;

a second plurality of reinforcing threads, each reinforcing thread of the second plurality of reinforcing threads being disposed in a respective gap of a second plurality of gaps, each respective gap of the second plurality of gaps disposed between at least two conductors of the second plurality of conductors; and a second insulator jacket covering the second plurality of conductor strands and the second plurality of reinforcing threads and in contact with a subset of the second plurality of conductor strands and a subset of the second plurality of reinforcing threads, wherein a first lamp assembly of the plurality of lamp assemblies is electrically connected to the first wire and the second wire.

2. The artificial tree of claim 1, wherein the first plurality of reinforcing threads is not twisted with the first plurality of conductor strands and the second plurality of reinforcing threads is not twisted with the second plurality of conductor strands.

3. The artificial tree of claim 1, wherein the first plurality of conductor strands is not substantially wrapped around the first plurality of reinforcing threads, and the second plurality of reinforcing threads is not substantially wrapped around the second plurality of conductor strands.

4. The artificial tree of claim 1, wherein the first and second pluralities of reinforcing threads each are made of a material selected from the group consisting of: nylon, polyester, polypropylene, rayon, Poly-paraphenylene terephthalamide, and mixtures thereof.

5. The artificial tree of claim 1, wherein the first and second pluralities of reinforcing threads each comprise a conductive metal having a higher resistivity than the conductor.

6. The artificial tree of claim 1, wherein the first and second insulator jackets each are made from a material comprising a plastic.

7. The artificial tree of claim 1, wherein at least one of the first and second wires is configured to transmit an electric control signal to the first lamp assembly.

8. The artificial tree of claim 1, wherein at least one of the first and second wires is configured to transmit electric power to the first lamp assembly.

9. The artificial tree of claim 1, wherein the first lamp assembly comprises:

a lamp having first and second electric terminals;

a lamp holder configured to house the lamp; and a first crimp connector configured to connect the first wire to the first electric terminal of the lamp.

10. The artificial tree of claim 9, wherein the first lamp assembly further comprises a second crimp connector configured to connect the second wire to the second electric terminal of the lamp.

11. The artificial tree of claim 9, wherein the first lamp assembly further comprises a flange configured to crimp around the first and second insulator jackets.

12. An artificial tree comprising:

a first trunk section including:

a first plurality of branches pivotally connected to the first trunk section;

a light set distributed on a first branch and a second branch of the plurality of branches, the light set including a plurality of lamp assemblies;

a plurality of reinforced wires electrically connecting the plurality of lamp assemblies, the plurality of reinforced wires comprising:

a first wire comprising:

a first plurality of conductor strands including a first central conductor oriented along at least a portion of a central axis of the first wire, the first plurality of conductor strands defining a first plurality of gaps, each gap of the first plurality of gaps being disposed between at least two conductors of the first plurality of conductor strands;

a first reinforcing strand comprising a first plurality of reinforcing threads, the first reinforcing strand being disposed in a gap of the first plurality of gaps; and a first insulator jacket covering the first plurality of conductor strands and the first reinforcing strand, wherein at least a first portion of the first insulator jacket contacts a subset of the first plurality of conductor strands and at least a second portion of the first insulator jacket contacts the first reinforcing strand;

a second wire comprising:

a second plurality of conductor strands including a second central conductor oriented along at least a portion of a central axis of the second wire, the second plurality of conductor strands defining a second plurality of gaps, each gap of the second plurality of gaps being disposed between at least two conductors of the second plurality of conductor strands;

a second reinforcing strand comprising a second plurality of reinforcing threads, the second reinforcing strand being disposed in a gap of the second plurality of gaps; and a second insulator jacket covering the second plurality of conductor strands and the second reinforcing strand, wherein at least a first portion of the second insulator jacket contacts a subset of the second plurality of conductor strands and at least a second portion of the second insulator jacket contacts the second reinforcing strand, wherein a first lamp assembly of the plurality of lamp assemblies is electrically connected to the first wire and the second wire.

13. The artificial tree of claim 12, wherein the first lamp assembly comprises:

a lamp having first and second electric terminals;

a lamp holder configured to house the lamp;

a first crimp connector configured to connect the first plurality of conductor strands to the first electric terminal of the lamp; and a second crimp connector configured to connect the first plurality of reinforcing threads to the lamp base.

14. The artificial tree of claim 13, wherein the first lamp assembly further comprises:

a third crimp connector configured to connect the second plurality of conductor strands to the second electric terminal of the lamp; and a fourth crimp connector configured to connect the second plurality of reinforcing threads to the lamp base.

15. The artificial tree of claim 12, wherein:

the first and second pluralities of reinforcing threads comprise a nylon yarn, the first and second pluralities of conductor strands comprise a portion of an AWG #22 stranded copper wire, and the first and second insulator jackets are made of a material comprising PVC.

16. An artificial tree comprising:

a first trunk section including:

a first plurality of branches pivotally connected to the first trunk section;

a light set distributed on first and second branches of the plurality of branches, the light set including a plurality of lamp assemblies;

a plurality of reinforced wires electrically connecting the plurality of lamp assemblies, the plurality of reinforced wires comprising:

a first reinforced electric wire comprising:

a first plurality of outer conductor strands, each conductor strand of the first plurality of outer conductor strands disposed a distance away from a central axis of the first reinforced electric wire;

a first plurality of inner conductor strands, each conductor strand of the first plurality of inner conductor strands disposed nearer the central axis of the first reinforced electric wire than each conductor strand of the first plurality of outer conductor strands;

a first reinforcing string comprising a first plurality of reinforcing threads, the first reinforcing string being disposed within a gap between at least two outer conductor strands of the first plurality of outer conductor strands; and a first insulator jacket covering the conductor strands and the reinforcing string, the first insulator jacket contacting the outer conductor strands and the reinforcing string;

a second reinforced electric wire comprising:

a second plurality of outer conductor strands, each conductor strand of the second plurality of outer conductor strands disposed a distance away from a central axis of the second reinforced electric wire;

a second plurality of inner conductor strands, each conductor strand of the second plurality of inner conductor strands disposed nearer the central axis of the second reinforced electric wire than each conductor strand of the second plurality of outer conductor strands;

a second reinforcing string comprising a second plurality of reinforcing threads, the second reinforcing string being disposed within a gap between at least two outer conductor strands of the second plurality of outer conductor strands; and a second insulator jacket covering the conductor strands and the reinforcing string, the second insulator jacket contacting the outer conductor strands and the reinforcing string, wherein a first lamp assembly of the plurality of lamp assemblies is electrically connected to the first wire and the second wire.

17. The artificial tree of claim 16, wherein at least one of the first and second wires is configured to transmit electric power to the first lamp assembly.

18. The artificial tree of claim 16, wherein at least one of the first and second wires is configured to transmit an electric control signal to the first lamp assembly.

19. The artificial tree of claim 16, wherein the first plurality of reinforcing threads is not twisted with the first plurality of conductor strands and the second plurality of reinforcing threads is not twisted with the second plurality of conductor strands.

20. The artificial tree of claim 16, wherein at least a first portion of the first insulator jacket contacts a subset of the first plurality of conductor strands and at least a second portion of the first insulator jacket contacts the first reinforcing string.

* * * * *